US005835001A

United States Patent [19]

Hofsäss

[11] Patent Number: 5,835,001

[45] Date of Patent: Nov. 10, 1998

[54] TEMPERATURE-DEPENDENT SWITCH HAVING A MOVABLE CONTACT CARRYING A HEATING RESISTOR

[76] Inventor: Marcel Hofsäss, Bodelschwinghstr. 36, D-75179 Pforzheim, Germany

[21] Appl. No.: 760,861

[22] Filed: Dec. 5, 1996

[30] Foreign Application Priority Data

Dec. 9, 1995 [DE] Germany ..... 195 45 998.9

[51] Int. Cl.[6] ..... H01H 61/02

[52] U.S. Cl. ..... 337/104; 337/85; 337/333; 337/377

[58] Field of Search ..... 337/101–107, 337/333, 342, 343, 377; 361/24–26, 103, 105

[56] References Cited

U.S. PATENT DOCUMENTS

| | | | |
|---|---|---|---|
| 2,300,807 | 11/1942 | Ray . | |
| 3,602,862 | 8/1971 | D'Entremont | 337/104 |
| 4,015,229 | 3/1977 | Senor et al. | 337/102 |
| 4,337,451 | 6/1982 | Fox | 337/101 X |
| 4,376,926 | 3/1983 | Senor | 337/104 |
| 5,367,279 | 11/1994 | Sakai | 337/104 |

FOREIGN PATENT DOCUMENTS

| | | |
|---|---|---|
| 0376660 | 7/1990 | European Pat. Off. . |
| 0284916 | 3/1988 | Germany . |
| 3710672 | 10/1988 | Germany . |
| 4142716 | 6/1993 | Germany . |

*Primary Examiner*—Leo P. Picard
*Assistant Examiner*—Jayprakash N. Gandhi
*Attorney, Agent, or Firm*—Harness,Dickey & Pierce, P.L.C.

[57] ABSTRACT

A temperature-dependent switch comprises a temperature-dependent switching mechanism having an electrically conductive spring element carrying a movable contact element. A first counter-contact is provided that coacts with said movable contact element to constitute a first switching contact pair that is opened and closed as a function of the temperature of the switching mechanism. A first heating resistor is provided for influencing the temperature of the switching mechanism at least in one switching state of the latter. The first heating resistor is provided on the movable contact element.

16 Claims, 2 Drawing Sheets

TEMPERATURE-DEPENDENT SWITCH HAVING A MOVABLE CONTACT CARRYING A HEATING RESISTOR

BACKGROUND OF THE INVENTION

1. Field of the Invention

The present invention relates to a switch having a switching mechanism, that switches in the presence of overtemperature, including an electrically conductive spring element on which is arranged a movable contact element that coacts at least with a first countercontact and constitutes with the latter a first switch contact that is open or closed as a function of the temperature of the switching mechanism, and having at least a first heating resistor.

2. Description of Related Art

A switch of this kind is known from DE 37 10 672 A1.

The known switch is a temperature controller for an electrical load, and comprises a bimetallic switching mechanism, which opens in the presence of overtemperature, with which the heating resistor is connected in parallel.

The object of the known temperature controller is to interrupt current flow through the electrical load if that load is at too high a temperature. For this purpose, the known temperature controller is connected in series with the load, so that the current flowing through the load flows through the temperature controller, the bimetallic switching mechanism and thus the switch contact being closed at temperatures below the response temperature.

If the temperature of the load then exceeds a predefined limit value, the bimetallic switching mechanism, which is in thermal contact with the load, suddenly opens its contacts by the fact that a bimetallic snap disk inside the bimetallic switching mechanism kicks over. The current now flows through the heating resistor, connected in parallel with the switching mechanism, which has sufficient resistance that the current is now very much less than the original operating current, so that the load is almost shut down. Because of the heat generated in the heating resistor, the bimetallic snap disk is heated up again so that it remains, in self-holding fashion, in its position with the contacts open, preventing automatic reactivation from occurring if the load cools down, which could lead to contact "fluttering" with repeated periodic activations and shutdowns.

In order to minimize the physical size of the known temperature controller, the heating resistor that is connected in parallel is integrated into the housing of the bimetallic switching mechanism. The housing comprises a cup-shaped lower housing part and an associated cover part; the latter can be made either of insulating material or of an electrically conductive resistive material.

Arranged in the lower housing part are the bimetallic snap disk as well as a spring disk which carries the movable contact element, with which a fixed countercontact, that is carried by the cover part, is associated. The spring disk presses the movable contact element against the fixed countercontact and simultaneously diverts the current flowing through the contacts to the lower housing part, on which a first external terminal is mounted. The second external terminal of the known temperature controller is arranged on the cover part, and is in electrically conductive contact, through the cover part, with the fixed countercontact. The aforesaid bimetallic snap disk, which suddenly snaps over when a specific response temperature is exceeded and thereby lifts the movable contact element away from the fixed countercontact, acts on the spring disk so that current flow through the bimetallic switching mechanism is interrupted. Current now flows through the heating resistor connected in parallel, and thus effects the self-holding already explained. The heating resistor can either consist of the resistive material of the cover part, or can be printed onto the cover part if the latter is made from insulating material.

It is a disadvantage of the known temperature controller that in the case of the embodiment, in which the cover part is made of electrically conductive resistive material, an insulating sheath is necessary between the cover part and the lower housing part in order to ensure a defined current path. It is further disadvantageous that in the case of this embodiment, the housing is not capable of handling high pressures. If, on the other hand, the heating resistor is configured by means of a printed-on resistive path, it is disadvantageous that this resistive path must be configured in a spiral shape and/or in curves in order to achieve the desired current profile. In both cases, the disadvantage concerns the high production outlay.

A further temperature controller is known from DE 41 42 716 A1. This temperature controller comprises a bimetallic switching mechanism which opens in the presence of overtemperature or overload, with which a first heating resistor is connected in parallel and a second heating resistor is connected in series. The series-connected heating resistor provides current monitoring: if the current through the load and therefore through the bimetallic switching mechanism reaches a predefined limit value, the series-connected heating resistor heats up to the extent that the bimetallic switching mechanism finally reaches its response temperature and opens. Self-holding occurs in this instance in the same manner as described above.

The series-connected heating resistor is arranged, as an etched or punched part or as a film with a resistor imprinted on it, in the immediate vicinity of and in thermal and electrical contact with the spring disk of the bimetallic switching mechanism, in such a way that it comes to rest in the bottom of the base part of the housing.

In addition to the complex assembly of the known temperature controller, a further disadvantage is that the etched or punched parts used here as heating resistors require an additional insulating component between them and the housing bottom; for reasons of resistance adjustment, in most cases another additional high-ohmic resistor, placed externally, is also required in series with the aforesaid dropping resistor, all of which increases the production outlay.

SUMMARY OF THE INVENTION

Proceeding from this, it is the object of the present invention to improve the switch mentioned at the outset in such a way that as few components as possible are needed, so that the new switch can be manufactured quickly and economically.

According to the invention, this object is achieved by the fact that the first heating resistor is provided on the movable contact element.

The object underlying the invention is completely achieved in this manner. Specifically, with the new switch it is no longer necessary to provide the heating resistor as a separate component and to install it in the housing, optionally with an insulating element interposed. A first advantage of the new switch thus consists in the fact that the number of components is greatly reduced: in order to implement the heating resistor and optionally an insulating layer, no further components are necessary aside from the movable contact element that is necessary in any case. A second advantage of the new switch results, however, from the simplified assembly, since now only the contact part, which must be installed in any case, has to be introduced into the switch; the heating resistor is thereby also concurrently installed, so that additional assembly steps during production are eliminated here.

The said heating resistor can, depending on the wiring pattern, provide a self-holding function, overtemperature protection, or simply preheating in order to adjust the switching point, to which end it must be connected, with the switching mechanism in either the open or the closed state, in series with it between external terminals of the switch, as will be explained even more precisely later with reference to the specific embodiments.

It is preferred in this connection if a second heating resistor is provided, which is also configured on the movable contact element that coacts with a second countercontact and with it constitutes a second switch contact that has a switching state opposite to the first switch contact.

The advantage here is that the second heating resistor is also implemented on the contact element, so that the switch with overtemperature and overload protection can be constructed much more simply since considerably fewer components are needed. As a result, costs are reduced not only because of reduced inventory and the lower number of components, but also because of simplified assembly.

It is preferred in this context if the switching mechanism is configured as an alternating switch, such that in a first switching state in which the first switch contact is closed, the first heating resistor is connected in series between the external terminals of the switch, and in a second switching state in which the second switch contact is closed, the second heating resistor is connected in series between the external terminals.

In an embodiment, it is preferred if the movable contact element is made at least in a resistance region from resistive material.

The advantage here is that the resistance value of the heating resistors can be determined by the geometry and the material. Constantan or other suitable alloys, thermistor material or other suitable ceramics, doped semiconductor materials, graphite, etc. can be used, for example, as the resistive material. The new switch can thus be easily adapted, by way of material selection and geometry, to the requisite response values in terms of self-holding, overload protection, or preheating. Switching mechanisms with different response parameters can thus be constructed in modular fashion, different contact elements being used as required.

In a further embodiment, it is preferred if the movable contact element is coated at least locally with resistive material.

The advantage here is that resistors can be arranged on already existing contact elements with no need to redesign the contact elements. These resistors can be provided, for example, using thick-layer or thin-layer technology, as a carbon resistor, or for example by sputtering as a thermistor resistor. In addition, new contact elements can also be manufactured which are configured with a plate on their side facing the countercontact, in order to make available a correspondingly large surface area for configuration of the resistor.

Overall it is preferred if the switching mechanism comprises an electrically conductive spring element which carries the movable contact element and is mechanically and electrically connected to the latter via a support region, the heating resistor being configured between the support region and a contact surface at which the contact element comes into contact with the countercontact.

This feature has the advantage, known per se, that the contact element is not only moved but also electrically contacted by means of the spring element, so that this also greatly simplifies the construction. The spring element can be either a bimetallic snap disk or a spring disk operating against the bimetallic snap disk. In the case of an alternating or toggle switch, for example, electrical connection of the movable contact element to the external terminals can be provided by the bimetallic snap disk in one switch position, and by the spring disk in the other.

It is further preferred if the contact element is made almost completely of resistive material, and the resistance value of the heating resistor is determined by the geometry of the contact element between support region and contact surface, and the specific resistance of the resistor material.

This feature is again advantageous in terms of production engineering, since the entire movable contact element can be made of a single material, so that manufacturing can be accomplished very simply and economically. All that must then be considered, in order to be able to set the correct resistance value of the heating resistor for the particular applicable specific resistor, is the geometry of the movable contact element in the region between the contact surface and the support region.

In addition, it is preferred if the resistive layer constitutes the contact surface and/or the support region.

The advantage here is that a series connection between the contact element, the heating resistor, the countercontact, and the electrically conductive spring element is attained in simple fashion. Depending on geometrical circumstances, the resistive layer can be applied onto the support region or onto the contact surface, so that existing contact elements can easily be equipped with a heating resistor.

It is preferred in this context if the spring element is a spring disk that operates against a bimetallic snap disk, and if the switch comprises a housing with an electrically conductive lower housing part in which the switching mechanism is arranged, and a cover part, capping the lower housing part, on which the first countercontact is arranged, such that the spring element pushes the contact element against the first countercontact and to that end supports itself internally against the lower housing part.

The advantage here is that a simple mechanical construction is achieved, although it is known per se from the prior art. Switches of this kind are also known as encapsulated switches, in which the switching mechanism is protected against outside influences, contact being made via the lower housing part and the cover part, the latter either being itself electrically conductive or being made of an insulating material and having a through contact to the first countercontact.

It is further preferred if the second countercontact is arranged on the bottom of the lower housing part.

The advantage here is that a bimetallic switching mechanism known per se in terms of design can be used, which now, in its switch position assumed in the presence of overtemperature, pushes the movable contact part downward onto the second countercontact which is now provided there.

Further advantages are evident from the description and the attached drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the drawings and will be explained further in the description below, in which.

DETAILED DESCRIPTION OF A PREFERRED EMBODIMENT

Figure 1:
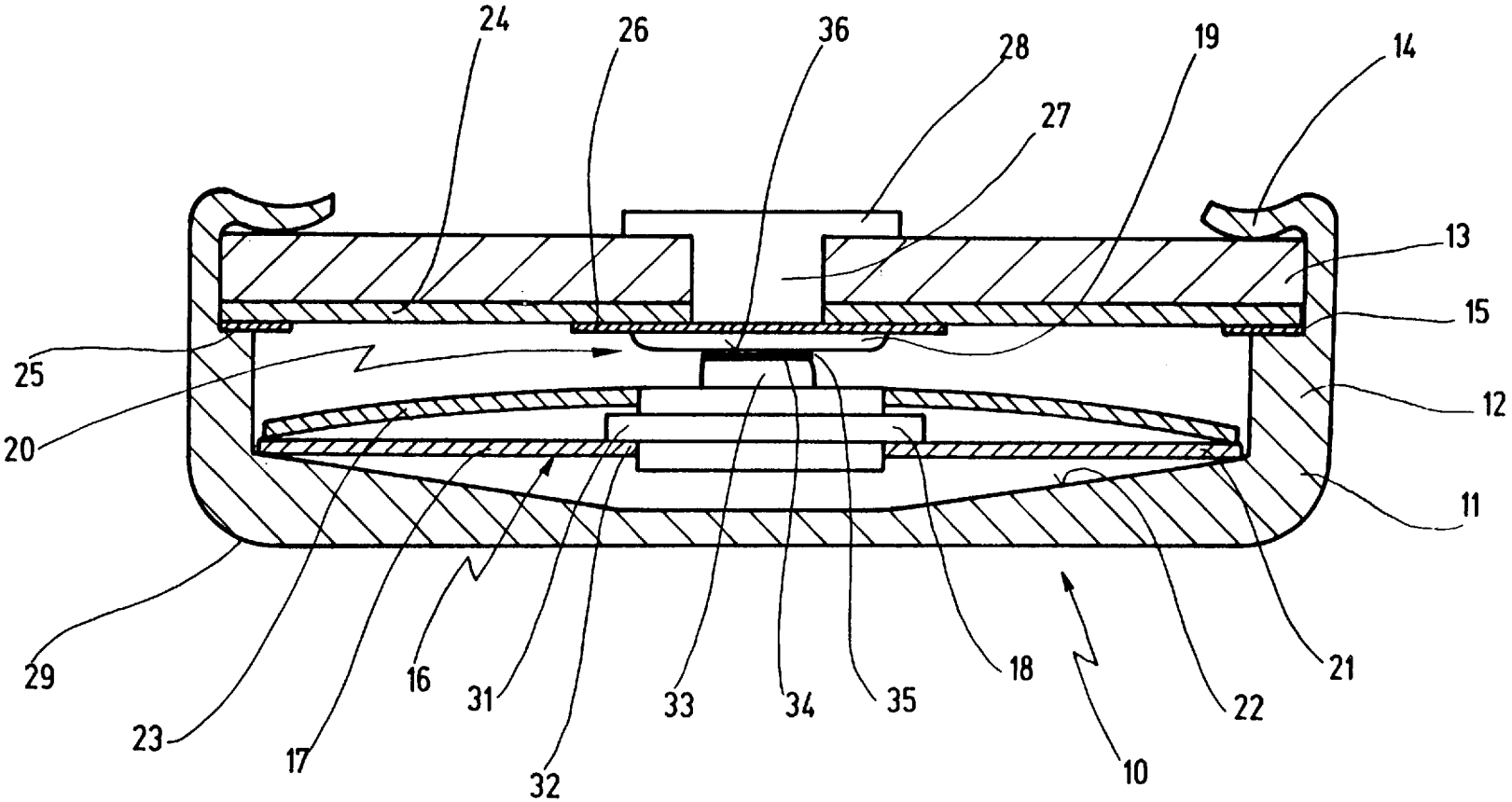
FIG. 1 shows a sectioned side view of a first embodiment of the new switch.

In FIG. 1, 10 indicates a switch which comprises a housing 11 with a lower housing part 12 and a cover part 13. Lower housing part 12 has a crimped rim 14 by means of which cover part 13 is pressed onto a shoulder 15 of lower housing part 12, so that overall an encapsulated housing 11 results.

Arranged in the interior of lower housing part 12 is a bimetallic switching mechanism 16 which comprises a spring element in the form of a spring disk 17 which carries a movable contact element 18. Associated with movable contact element 18 is a countercontact 19 that is arranged on the inside of cover part 13. Movable contact element 18 and countercontact 19 constitute a so-called switch contact, a switching contact pair 20.

Spring disk 17 is supported at its rim 21 against bottom 22 of lower housing part 12 in order to press contact element 18 against countercontact 19.

A bimetallic snap disk 23, which in the state shown in FIG. 1 is below its response temperature, is slipped over contact element 18.

A heating resistor 24, which is electrically connected via a contact ring 25 to shoulder 15 of lower part 12, which is made of electrically conductive material, is provided on the inside of cover part 13. Heating resistor 24 is electrically connected via an inner contact ring 26 to countercontact 19, which is connected through a rivet 28 to a first terminal 28 provided on cover part 13, which is made of insulating material. A second terminal 29 of switch 10 is constituted by lower housing part 12 itself.

Because of the design selected, heating resistor 24 is connected in parallel with bimetallic switching mechanism 16, and is electrically shorted out by the latter in the switching state shown in FIG. 1. When bimetallic snap disk 23 is then heated to a temperature above its response threshold, it snaps over from the convex shape (as shown) into a concave shape, thereby pushing movable contact element 18 away from countercontact 19 so that it lifts away from the latter. To this end, the bimetallic snap disk can support itself against the inside of cover part 13. If bimetallic snap disk 23 should, in the process, be able to come into contact with heating resistor 24, suitable insulating features should be provided, which for the sake of clarity are not shown in FIG. 1.

In this open state, current now flows through heating resistor 24, which heats up and thus acts to perform a self-holding function, since it keeps bimetallic switching mechanism 16 open.

Movable contact element 18 is a substantially cylindrical part with an annular shoulder 31 arranged centeredly, by means of which contact element 18 is clamped between spring disk 17 and bimetallic snap disk 23. Annular shoulder 31 thereby comes to rest against a support region 32 on spring disk 17, so that it is connected not only mechanically but also electrically to electrically conductive spring disk 17.

Contact element 18 has, facing countercontact 19, a projection 33 on which is provided a resistive layer 34 that constitutes a heating resistor 35, which in the switching state shown in FIG. 1 is in contact at its contact surface 36 with countercontact 19.

In the switching state shown in FIG. 1, the current flowing through switch 10 flows through heating resistor 35, since it is connected in series with bimetallic switching mechanism 16 between external terminals 28 and 29. The resistance values of heating resistors 24 and 35 are adjusted in such a way that when switch 10 is closed, the current flows substantially through heating resistor 35. This heating resistor 35 can now be used either for preheating of bimetallic switching mechanism 16, so that the switching point can be precisely set, or it is possible by means of heating resistor 35 to set a current sensitivity such that when current flow through switching mechanism 10 is too high, the response temperature of bimetallic snap disk 23 is exceeded and switch 10 opens switch contact 20.

It should also be noted that resistive layer 34 can be applied onto movable contact element 18 using thick-layer or thin-layer technology, as a carbon resistor, as a PTC element, for example by sputtering, or using another suitable technology.

Figure 2:
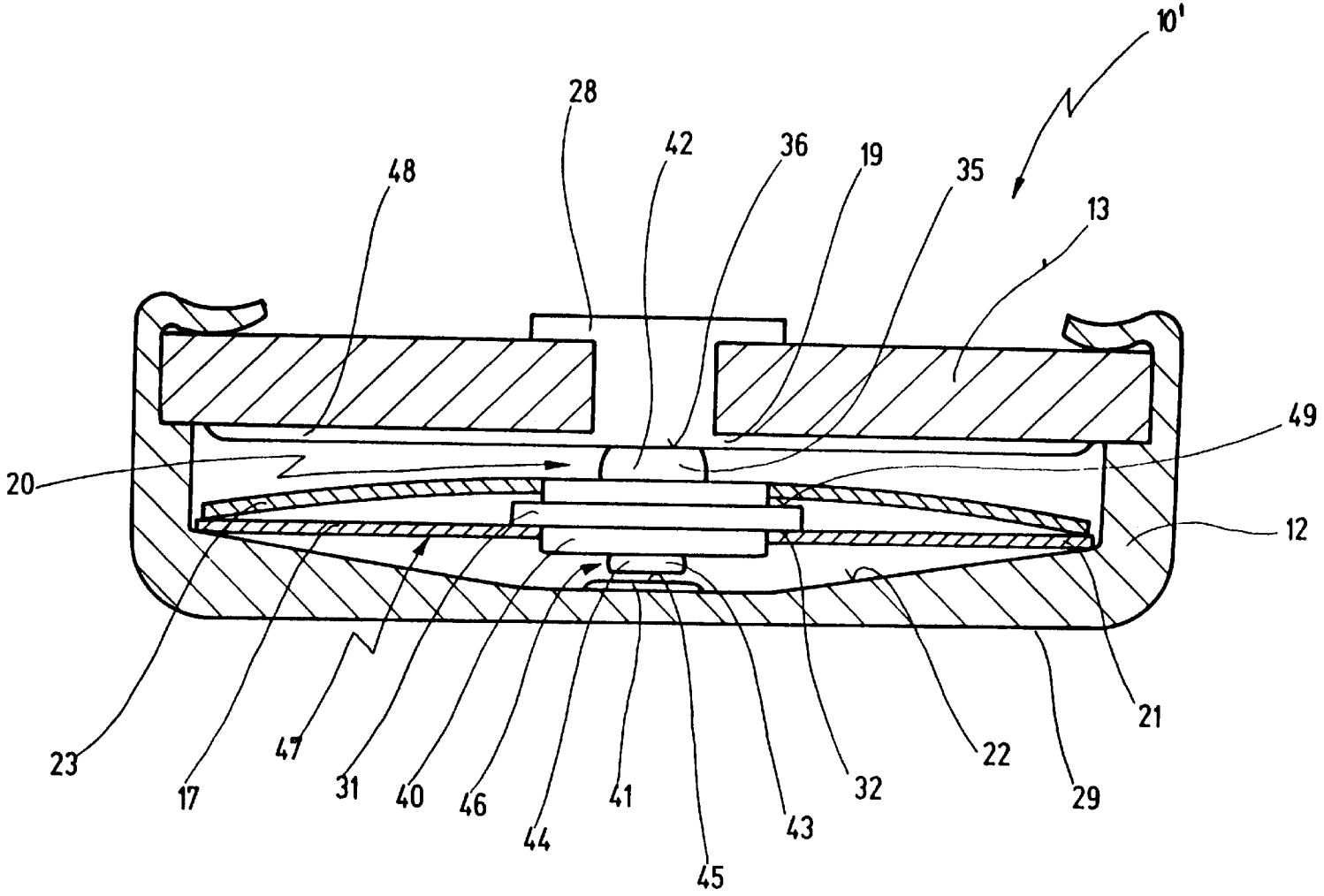
FIG. 2 shows, in a representation similar to FIG. 1, a second embodiment of the new switch.

FIG. 2 shows, in a representation similar to FIG. 1, a further switch 10' in which cover part 13 is made entirely of insulating material and has no heating resistor.

Here spring disk 17 carries a movable contact element 40 that coacts not only with a first countercontact 19, but also with a second countercontact 41 that is arranged on bottom 22 of lower housing part 12. Contact element 40 has an upper projecting resistive region 42 that acts as heating resistor 35 and is in contact, via contact surface 36, with countercontact 19 when the switching state shown in FIG. 2 has been assumed.

On its opposite side, movable contact element 40 has a second projecting resistive region 43 that acts as heating resistor 44 and takes on the role of heating resistor 24 from FIG. 1. Resistive region 43 can be brought into contact, via its contact surface 45, with second countercontact 41, together with which movable contact element 40 constitutes a second switch contact 46.

In the design shown in FIG. 2, bimetallic switching mechanism 16 is configured as an alternating switch 47. For this purpose, first countercontact 19 is joined to a contact layer 48 that is arranged on the inside of cover part 13. If the temperature of switch 10' shown in FIG. 2 is elevated above the response temperature, once again bimetallic snap disk 23 snaps over and thereby comes into contact with contact layer 48. At the same time, movable contact element 40 is pushed downward in FIG. 2, so that it comes into contact with second countercontact 41 and closes second switch contact 46, while first switch contact 20 is opened.

Depending on the design of alternating switch 47, the current flowing through switch 10' now flows from external terminal 28 via contact layer 48 into bimetallic snap disk 23, and from that either into spring disk 17, which is still in contact at its rim 21 with the said bimetallic spring disk 23, or via bimetallic spring disk 23 and a support region 49 on annular shoulder 31 into contact element 40. From here the current passes through heating resistor 44 and second countercontact 41 to external terminal 29, so that second heating resistor 44 is connected in series with the bimetallic switching mechanism between external terminals 28, 29.

Because bimetallic switching mechanism 16 is configured as an alternating switch 47, one heating resistor 35 or 43 is therefore always located in series between external terminals 28, 29 of switch 10'. Heating resistor 35, connected between external terminals 28, 29 when switch 10' is in the idle position, acts to implement an overload sensitivity or provides preheating, while heating resistor 44 implements the self-holding function.

Of course it is also possible to implement switch 10' without current sensitivity, to which end heating resistor 35 would need to be omitted.

It should also be mentioned that the projecting resistive regions 42, 43 can be made of any suitable resistive material, for example constantan, a usual resistive alloy, a doped semi-conductor material, a PTC ceramic or similar ceramics, or even graphite. The geometry of contact element 40 between support surfaces 32 and 49 and contact surfaces 36 and 45 governs the setting of the resistance value of the respective heating resistor. Of course movable contact element 40 can be made entirely of a resistive material, which makes contact element 40 itself very easy to manufacture.

Of course in the case of contact element 40 it is also possible to provide, instead of resistive regions 42, 43, projections 42, 43 that are equipped with a resistive layer, so that the heating resistors are configured like heating resistor 35 in FIG. 1.

I claim:

1. A temperature-dependent switch, comprising:

a temperature-dependent switching mechanism having an electrically conductive spring element carrying a movable contact element, a first countercontact coacting with said movable contact element to constitute a first switching contact pair that is opened in a first switching state and closed in a second switching state as a function of the temperature of said switching mechanism, at least a first heating resistor provided for influencing the temperature of said switching mechanism in at least one of said first and second switching state of said switching mechanism, wherein said first heating resistor is provided on said movable contact element.

2. The switch of claim 1, comprising a second heating resistor provided on said movable contact element and a second countercontact coacting with said movable contact element to constitute a second switching contact pair that is opened and closed opposite to said opening and closing of said first switching contact pair.

3. The switch of claim 2, wherein the switching mechanism is configured as an alternating switch, such that in a first switching state in which the first switching contact pair is closed, the first heating resistor is connected in series between external terminals of the switch, and in a second switching state in which the second switching contact pair is closed, the second heating resistor is connected in series between the external terminals.

4. The switch of claims 1, wherein the movable contact element is made at least in a resistance region from resistive material.

5. The switch of claim 1, wherein the movable contact element is coated at least locally with resistive material.

6. The switch of claim 1, wherein the movable contact element is mechanically and electrically connected to the electrically conducted spring element via a support region, the heating resistor being configured between the support region and a contact surface at which the contact element comes into contact with the countercontact.

7. The switch of claim 5, wherein the movable contact element is mechanically and electrically connected to the electrically conducted spring element via a support region, the heating resistor being configured between the support region and a contact surface at which the contact element comes into contact with the countercontact.

8. The switch of claim 7, wherein the resistive layer constitutes the contact surface.

9. The switch of claim 4, wherein the movable contact element is mechanically and electrically connected to the electrically conducted spring element via a support region, the heating resistor being configured between the support region and a contact surface at which the contact element comes into contact with the countercontact.

10. The switch of claim 9, wherein the contact element is made almost completely of resistive material, and the resistance value of the heating resistor is determined by the geometry of the contact element between support region and contact surface, and the specific resistance of the resistor material.

11. The switch of claim 6, wherein the spring element is a spring disk that operates against a bimetallic snap disk.

12. The switch of claim 11, comprising a housing with an electrically conductive lower housing part in which the switching mechanism is arranged, and a cover part, capping the lower housing part, on which the first countercontact is arranged, such that the spring element pushes the contact element against the first countercontact and to that end supports itself internally against the lower housing part.

13. The switch of claim 12, comprising a second heating resistor provided on said movable contact element and a second countercontact coacting with said movable contact element to constitute a second switching contact pair that is opened and closed opposite to said opening and closing of said first switching contact pair.

14. The switch of claim 13, wherein the second countercontact is arranged on the bottom of the lower housing part.

15. The switch of claim 7, wherein the resistive layer constitutes the support region.

16. The switch of claim 8, wherein the resistive layer also constitutes the support region.

* * * * *